US007321282B2

(12) United States Patent
Lee et al.

(10) Patent No.: US 7,321,282 B2
(45) Date of Patent: Jan. 22, 2008

(54) MEM'S REED SWITCH ARRAY

(75) Inventors: Robert E. Lee, Garden City, NY (US); Kenneth G. Eskildsen, Great Neck, NY (US); Kevin G. Piel, Ronkonkoma, NY (US)

(73) Assignee: Honeywell International, Inc., Morristown, NJ (US)

( * ) Notice: Subject to any disclaimer, the term of this patent is extended or adjusted under 35 U.S.C. 154(b) by 242 days.

(21) Appl. No.: 11/059,821

(22) Filed: Feb. 17, 2005

(65) Prior Publication Data

US 2006/0181374 A1 Aug. 17, 2006

(51) Int. Cl.
*H01H 9/00* (2006.01)

(52) U.S. Cl. ..... 335/205; 335/151; 335/152; 335/154; 335/206; 340/547

(58) Field of Classification Search ..... 335/151–154, 335/205–207; 340/547
See application file for complete search history.

(56) References Cited

U.S. PATENT DOCUMENTS 3,654,515 A * 4/1972 Kato et al. ..... 361/45
3,945,387 A * 3/1976 Adams ..... 607/31
4,945,340 A 7/1990 Brill
5,430,421 A * 7/1995 Bornand et al. ..... 335/154
6,348,861 B1 * 2/2002 Li ..... 340/547
2004/0267233 A1 * 12/2004 Ginggen ..... 604/500

* cited by examiner

*Primary Examiner*—Ramon M. Barrera
(74) *Attorney, Agent, or Firm*—Scully, Scott, Murphy & Presser, P.C.

(57) ABSTRACT

A MEM's reed switch array is provided having a first switch having a sensitivity causing the first switch to open or close due to a magnetic flux, and a second switch of lesser sensitivity than the first switch causing the second switch to open or close due to a magnetic flux. The first switch can be parallel to the second switch, or the first switch can be proximate to the second switch so that a center line of the first switch is coaxial to a center line of the second switch. Further, a security device for residential and/or commercial use is provided, having a magnet housing having a magnet, a switch housing having a MEM's reed switch array with a first switch and a second switch, and a gap between the magnet housing and the switch housing.

39 Claims, 5 Drawing Sheets

MEM'S REED SWITCH ARRAY

BACKGROUND OF THE INVENTION

1. Field of the Invention

The present invention relates to reed switch arrays, and more specifically, to a micro electromechanical systems (MEM's) reed switch array.

2. Prior Art

Reed switches are magnetically actuated switches, which are typically manufactured with two ferromagnetic reeds (contact blades) spaced a distance apart, which are sealed in a glass capsule. In the presence of a magnet, the blades (contacts) are deflected until they contact. This arrangement can be compromised by introducing a magnetic field with the same pole orientation as the magnet used in the assembly.

Reed switch types consist of dry reed or mercury wetted reed switches. A dry reed switch contains ferromagnetic contact blades sealed in a glass container with an inert gas. In a mercury wetted reed switch, mercury is the contact material for an electrical circuit. The contacting faces are renewed by capillary action drawing a film of mercury over the surfaces of the constant switching members as the movable contact member is moved from one position to another. The center position on reed switches can be center gap or off center gap. The gap is the contact meeting point of the switch.

Most current reed switch assemblies use a single form A reed switch that is a normally open (NO) switch. Some more expensive reed switch assemblies use a single form C reed switch that consists of a normally open (NO), normally closed (NC) and common connection. A normally open (NO) switch has contacts that are open or disconnected in their unactuated (normal) position. A normally closed (NC) switch has contacts that are closed or connected in their unactuated (normal) position. High security switches utilize arrays of form A and C reed switches and are much larger and significantly more expensive.

Conventional reed switches have a range of operation. These reed switches are mass produced and sorted by sensitivity (i.e. ampere turn) into various ranges. The tighter the sensitivity range, the more expensive the reed switch is. The preferred, i.e. more sensitive, switches also tend to be more expensive. As conventional reed switch arrays decrease in size, the cost increases and the range of sensitivity increases, and there is a greater variation in performance. In the manufacturing process, the glass also tends to fracture causing yield issues. To address the issue of tamper protection, high security contacts have been designed using arrays of reed switches which detect the introduction of another magnetic field. However, the cost of these switches is significant.

Thus, there remains a distinct need in the market for a reed switch array that has a small size, an increased range of sensitivity, tamper protection, and is less expensive to manufacture than existing solutions.

SUMMARY OF THE INVENTION

Therefore, it is an object of the present invention to provide a MEM's reed switch array that has a smaller size, an increased range of sensitivity, is inexpensive to manufacture, and has a higher level of tamper protection than prior art solutions.

To achieve the foregoing and other objects and in accordance with the purpose of the present invention, as embodied and broadly described herein, a MEM's reed switch array is provided that comprises a first switch having a sensitivity causing the first switch to open or close due to a magnetic flux, and a second switch of lesser sensitivity than the first switch causing the second switch to open or close due to a magnetic flux.

The first switch comprises a first leg and a second leg, wherein the magnetic flux causes the first leg to come in contact with the second leg, causing the first switch to close. The second switch comprises a first leg and a second leg, wherein the magnetic flux is insufficient to cause the first leg to come in contact with the second leg, causing the second switch to stay open.

The first leg and the second leg of the first and second switches are made of or are plated with magnetic material. The first leg and the second leg of the first and second switches are etched in silicon, and are plated with a ferrous material. The first and second legs of the first and second switches are plated with a non oxidizing material, such as ruthenium, nickel or gold. The first and second legs of the first switch are made longer than the first and second legs of the second switch.

The first switch and second switch can be both open, due to an insufficient flux or no flux, triggering an alarm. The first switch can be closed and the second switch can be open, due to a proper magnetic flux being present, not triggering an alarm. The first switch and second switch can both be closed, due to excess magnetic flux, triggering a tamper condition.

The first switch can be parallel to the second switch, or the first switch can be proximate to the second switch so that a horizontal center line of the first switch is coaxial to a horizontal center line of the second switch. The first and second switches can be located inside a switch housing.

The MEM's reed switch array can further comprise a third switch having a sensitivity similar to the first switch, a fourth switch having a sensitivity similar to the second switch, and a center switch in between the first and third switches and the second and fourth switches, the center switch having a nominal sensitivity. The first, second, third, fourth and center switches can be parallel to each other, or a horizontal center line of the first, second, third and fourth switches can all be coaxial to a horizontal center line of the center switch. The first, second, third, fourth and center switches can be located inside a switch housing.

Also, a security device for residential and/or commercial use is provided, the security device comprising a magnet housing having a magnet, a switch housing having a MEM's reed switch array, the MEM's reed switch array comprising a first switch having a sensitivity causing the first switch to open or close due to a magnetic flux and a second switch of lesser sensitivity than the first switch causing the second switch to open or close due to a magnetic flux, and a gap between the magnet housing and the switch housing.

The security device for residential and/or commercial use further comprises a printed circuit board for holding the MEM's reed switch array, and circuitry means on the printed circuit board for processing switch positions of the first and second switches of the MEM's reed switch array.

The security device further comprises wire leads or a terminal block attached to the switch housing to send data back to an alarm panel via wires or an RF transmitter to send wireless data. The security device further comprises attachment means for attaching the switch housing to a surface, and an attachment means for attaching the magnet housing to a door or window.

The first switch can be parallel to the second switch, or the first switch can be proximate to the second switch so that a horizontal center line of the first switch is coaxial to a horizontal center line of the second switch.

The security device for residential and/or commercial use further comprises the MEM's reed switch array having a third switch having a sensitivity similar to the first switch, a fourth switch having a sensitivity similar to the second switch, and a center switch in between the first and third switches and the second and fourth switches, the center switch having a nominal sensitivity.

The security device has an operating range within a minimum operating gap and a maximum operating gap. The minimum operating gap is determined by the maximum distance of the second switch between the switch housing and the magnetic housing. The maximum operating gap is determined by the minimum distance of the first switch between the switch housing and the magnetic housing. An alarm is triggered when the gap between the switch housing and the magnetic housing exceeds a maximum distance that the first switch can be closed at, and a tamper warning is generated when the gap between the switch housing and the magnetic housing is less than a minimum distance required to close the second switch.

The above and other features of the invention, including various novel details of construction and combinations of parts, will now be more particularly described with reference to the accompanying drawings and pointed out in the claims. It will be understood that the particular device embodying the invention is shown by way of illustration only and not as a limitation of the invention. The principles and features of this invention may be employed in various and numerous embodiments without departing from the scope of the invention.

BRIEF DESCRIPTION OF THE DRAWINGS

These and other features, aspects, and advantages of the apparatus and methods of the present invention will become better understood with regard to the following description, appended claims, and accompanying drawings where:

DETAILED DESCRIPTION OF THE INVENTION

Although this invention may be applicable to various uses of reed switch arrays, it has been found particularly useful in the environment of alarm systems for commercial and residential structures. Therefore, without limiting the applicability of the invention to the above, the invention will be described in such environment.

Figure 1:
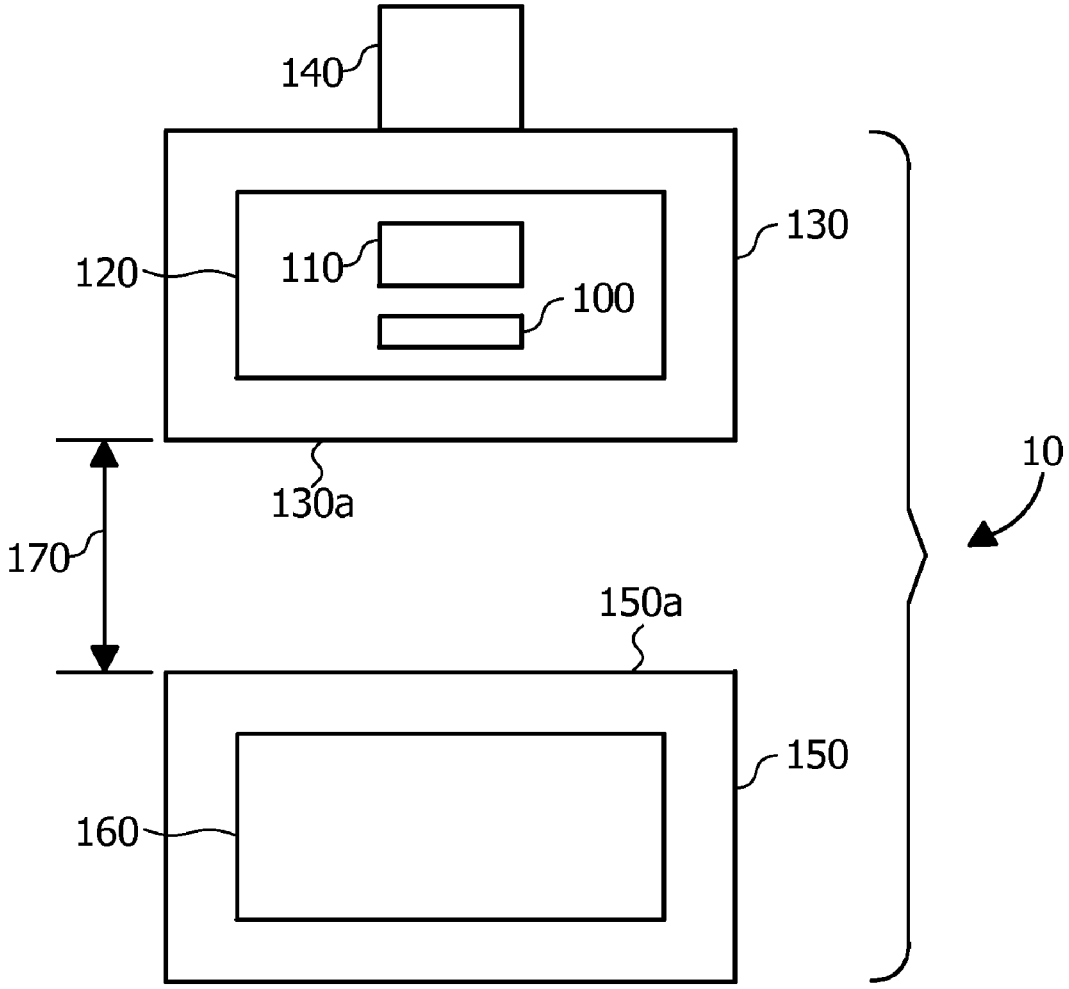
FIG. 1 shows the major components of a device in accordance with the present invention.

With reference now to the drawings, the components of the present invention will be described. In FIG. 1, a device 10 is shown comprising a magnet housing 150 and a switch housing 130. The distance between an outer surface 130*a* of the switch housing 130 and an outer surface 150*a* of the magnet housing 150 is referred to as a gap 170.

The magnet housing 150 contains a magnet 160 and an attachment means (not shown) for attaching it to a door or window. The magnet housing 150 can be constructed of any material such as plastic, aluminum, or other non-ferrous metal such as is used in contacts designed for garage doors or high security switches that need to be more resistant to attack. The attachment means can be any means for attaching the magnet housing to a door, wall or window, such as but not limited to screws, nails, double sided tape for surface mounted switches, and crush ribs for recess mounted switches.

The switch housing 130 contains a MEM's reed switch array 100, and a printed circuit board 120 or any other means for holding the MEM's reed switch array 100. The switch housing 130 is constructed of material similar to the magnetic housing. Optional circuitry 110 can be provided to process the switch positions of the MEM's reed switch array 100 locally. Terminal block or wire leads 140 can be provided to send data to an alarm panel (not shown) via wires or an RF transmitter to send wireless data. An attachment means (not shown) is also provided for attaching the switch housing 130 to a door or wall. The attachment means for attaching the switch housing 130 and the magnet housing 150 to a surface, and the terminal blocks or wire leads 140, are common practice in the industry, and known to one of ordinary skill in the art of the present invention.

Figure 2:
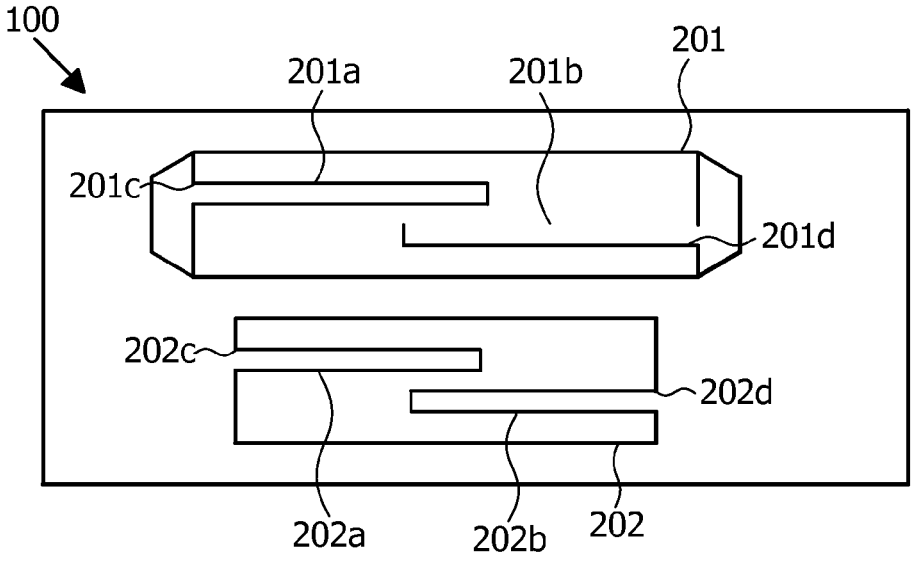
FIG. 2 shows a MEM's reed switch array constructed in accordance with an embodiment of the present invention.

FIG. 2 illustrates the construction of the MEM's reed switch array 100. In this example, two switches of different sensitivity are shown, a first switch 201 and a second switch 202. The first switch 201 is the more sensitive switch of the two switches. The second switch 202 is the less sensitive switch of the two switches. The first switch 201 and the second switch 202 are shown in an open position. The first switch 201 has a first leg 201*a* and a second leg 201*b*. The first leg 201*a* is supported at connection point 201*c* and the second leg 201*b* is supported at connection point 201*d*. The second switch 202 similarly has a first leg 202*a* and a second leg 202*b*. The first leg 202*a* is supported at connection point 202*c* and the second leg 202*b* is supported at connection point 202*d*.

In the embodiment as shown in FIG. 2, the position of the switches 201 and 202 in the MEM's reed switch array 100 is made so that the first switch 201 is parallel to the second switch 202. In another embodiment, shown in FIG. 2A, the first switch 201 and the second switch 202 are positioned inside the MEM's reed switch array 100 so that a horizontal center line of first switch 201 is coaxial to a horizontal center line of second switch 202. The relative position of first switch 201 with respect to second switch 202 is not significant, but the distance between the switches should be minimized in order to keep the MEM's reed switch array 100 a small size. Preferably, second switch 202 is either proximate to or below first switch 201. The distance between first switch 201 and second switch 202 is small compared to the distance between the switch housing 130 and the magnet housing 150.

The difference in sensitivity of the switches 201 and 202 is determined by the physical constraints of the device 10. The legs of the switches 201*a*, 201*b*, 202*a* and 202*b* are connected on one end and can pivot about the connection points 201*c*, 201*d*, 202*c* and 202*d*, respectively In FIGS. 2 and 2A, the length of the legs of the switches is varied. The length of the legs 201*a* and 201*b* of the first switch 201 are longer than the legs 202*a* and 202*b* of the second switch 202. The longer the legs, the more sensitive the reed switch, as the required deflection can be achieved with less force from the magnetic flux. Beam width, thickness and spacing between the legs of each switch are other means for varying the switch sensitivity. Tapering of the beam or other geometric shapes of the legs of the switches can also be employed.

The legs 201*a* and 201*b* of first switch 201, and the legs 202*a* and 202*b* of second switch 202 are made of or plated with magnetic material. When a magnetic flux is introduced, the legs 201*a* and 202*b* pull towards each other, and legs 202*a* and 202*b* pull towards each other, until they touch, causing the circuit to close. When the magnetic flux is removed, the legs 201*a* and 202*b* pull apart, and legs 202*a* and 202*b* pull apart, back to their stress free position and break the circuit.

The legs 201*a*, 201*b*, 202*a* and 202*b* can be formed by etching silicon and then plating the legs with a ferrous material. The legs are then plated with a non oxidizing coating such as ruthenium, nickel or gold. The geometry of the legs of the different switches can also be varied, thereby creating a MEM's reed switch array with multiple sensitivities.

Several embodiments are possible using different quantities of switches with varying orientation. Additional switches can be added and different positional and angular orientations of the switches can be implemented to provide higher levels of tamper protection.

Figure 3:
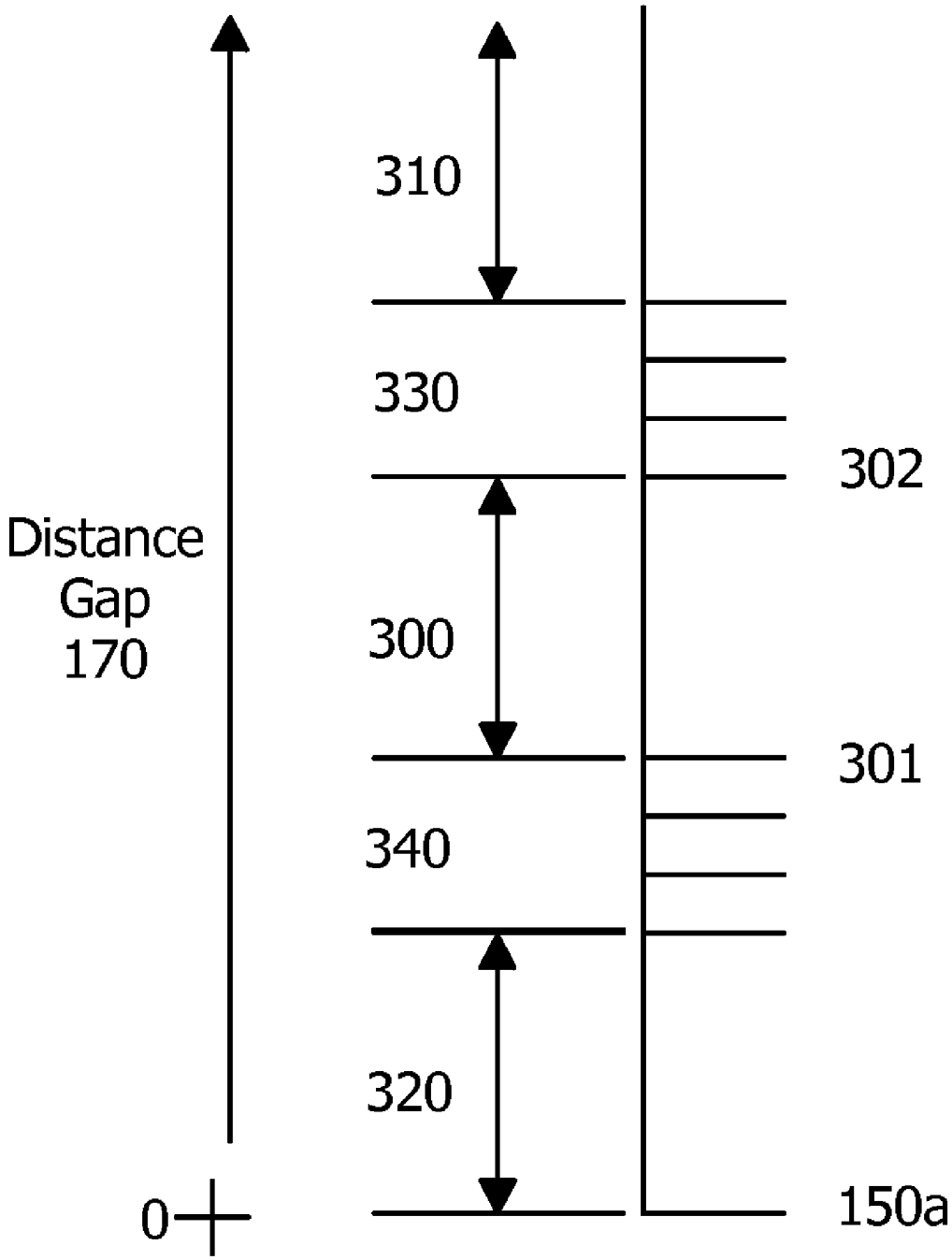
FIG. 3 shows a state of two switches in a MEM's reed switch array in accordance with the present invention based upon distance between the outside surface of the magnet and the switch housing.

FIG. 3 illustrates the state of first switch 201 and second switch 202 based upon the distance between the outer surface 150*a* of the magnet housing 150 and the outer surface 130*a* of the switch housing 130. In typical applications, the switch housing 130 is typically fixed and the magnet housing 150 is attached to a door or window that moves. The relative position of the magnet housing 150 with respect to the switch housing 130 is what is critical in this application. Therefore, either the switch housing 130, the magnet housing 150, or both housings can be allowed to move, keeping in mind that the critical criteria is the distance between the magnet housing 150 and switch housing 130.

For the purposes of FIG. 3, the magnet housing 150 will be assumed fixed. In order to achieve tamper protection, the range of operation of the device 10 will have a minimum operating gap 301 and a maximum operating gap 302. The distance between the minimum operating gap 301 and the maximum operating gap 302 is the operating range 300. Single switch devices have a minimum operating gap of zero and a maximum operating gap typically in the ½" to 3" range based upon reed switch sensitivity and magnet size and material (i.e. flux density). The minimum operating gap 301 is determined by the maximum distance of the second switch 202 between the two housings that will cause second switch 202 to open. The maximum operating gap 302 is determined by the minimum distance of the first switch 201 between the two housings that will cause first switch 201 to close.

In the device 10, two conditions can cause an alarm or a tamper condition to trigger. First, both switches 201 and 202 can be open, which indicates that the distance between the switch housing 130 and magnet housing 150 exceeds the maximum distance that first switch 201 can be closed at, causing an alarm to trigger (alarm range 310). Second, both switches can be closed, which indicates that the distance between the switch housing 130 and magnet housing 150 is less than the minimum distance required to close second switch 202, causing a tamper warning to trigger (tamper range 320).

There are also two areas of uncertainty (uncertain range 330 and uncertain range 340) caused by tolerance variation in the sensitivity of the switches, as well as variation caused by the hysteresis of the switches which is characterized by a pull in/drop out ratio. Both of these effects are typical of reed switches and known to one of ordinary skill in the art.

For a form A reed switch assembly, there is a nominal pull in distance, i.e., when the magnet 160 approaches a switch from a large distance, the distance that the switch closes is called the pull in distance. Switches will have a tolerance around this dimension (a.k.a. min pull in and max pull in). When the magnet 160 is adjacent to the switch and moved away, the distance that the switch opens is called the drop out distance. The tolerance around this point is the max drop out and min drop out. Each switch has a single pull in and drop out.

When looking at the switch as a system, there is a range in the pull in and drop out for a given tolerance on the switches. Taking parts of the specified tolerance and assembling as a system, the operating range 300 represents the lowest pull in distance and highest drop out distance, or dimensions which are guaranteed to work to. The uncertain ranges 330 and 340 are the regions where the switch may or may not be closed as a function of the tolerances of the system. Typical pull-in/drop out ratios are 60-95% depending upon manufacturer and physical design.

Figure 4A:
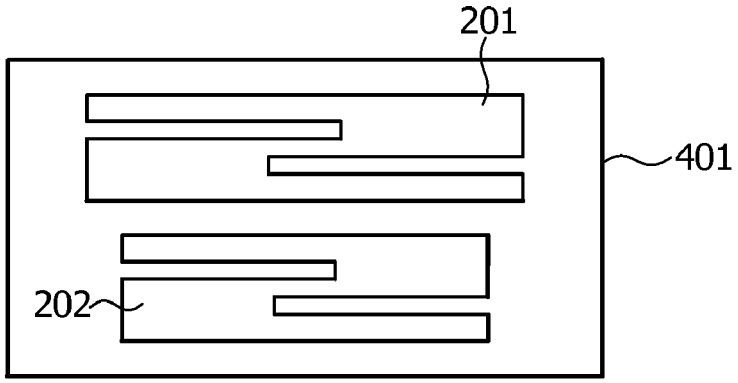
FIGS. 4*a*-4*c* show three states in which the two switches in a MEM's reed switch array in accordance with the present invention can exist.
Figure 4B:
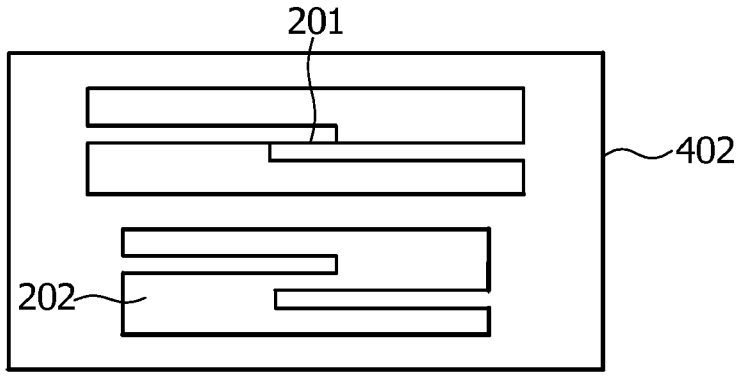
Figure 4C:
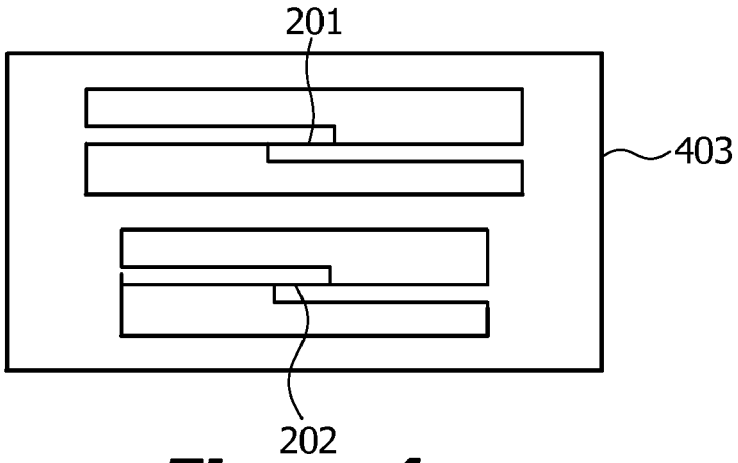

FIGS. 4A, 4B and 4C illustrate the three states in which the two switches 201 and 202 can exist. The distance between the switch housing can cause an alarm condition to generate, or a tamper warning to generate. An alarm condition generates when the magnet housing is pulled away from the switch housing. A tamper warning occurs when a person tries to introduce a second magnet.

FIG. 4A shows a first state 401 in which both first switch 201 and second switch 202 are in an open state. This occurs when there is an insufficient or no magnetic flux present. An open state of the two switches will cause an alarm to trigger. This open state of the two switches, however, does not generate a tamper warning.

FIG. 4B shows a second state 402 in which first switch 201 is closed and second switch 202 is in an open state. This occurs when the proper magnetic flux is present, i.e., the magnet housing 150 and the switch housing 130 are placed within the operating range 300. The alarm will not trigger in this state, and no tamper warning is generated.

FIG. 4C shows a third state 403 in which both first switch 201 and second switch 202 are in a closed state. This occurs when excess magnetic flux is present, or the magnet housing 150 and switch housing 130 are closer than the minimum operating gap 301. This will not cause the alarm to trigger, but will generate a tamper warning, as the introduction of a second magnet is the likely cause of the first switch closing.

A fourth possible scenario in which first switch 201 is open and second switch 202 is closed cannot be achieved, due to the difference in sensitivity between the two switches.

The present invention provides several advantages that solves the problems with prior art methods. By creating a MEM's reed switch array several advantages are realized. First, the cost of the MEM's chip is based upon the silicon die size utilized, the number of etching and plating process steps required, and the failure rate of the individual die. The required die size and complexity of the elements required will yield a low cost array of reed switches. Second, the need for sorting and handing switches in production is eliminated, and the masks for the MEM's chip will control the performance of the elements. Third, the size of the device will be significantly smaller. As conventional reed switch arrays decrease in size, the cost increases and the range of sensitivity increases. The present invention provides for a smaller reed switch array with greater sensitivity, without a significant cost.

Further, the present invention provides for a significant tamper protection feature. A conventional single reed switch can be defeated by introducing a second magnet with the same pole orientation as the magnet housing which will cause the minimum drop out distance not to be reached due to the increase in flux. The present invention achieves tamper protection by using two switches 201 and 202.

When the switch housing 130 and magnet housing 150 are within the operating range 300, introduction of a second magnet with the same pole orientation as the magnet housing 150 will cause second switch 202 to close due to the magnetic flux increase caused by the second magnet, triggering an alarm. Introduction of a second magnet with the opposite pole orientation as the magnet housing 150 will cause first switch 201 to open due to the magnetic flux decrease caused by the cancellation of fields by the second magnet, triggering the alarm. Thus, a significant benefit is provided by the use of two switches in the present invention.

In addition, the MEMS reed switch is a solid state device that is rugged and can be inserted using robotic machinery.

There are several other uses of the invention not limited by the description and embodiment as described above. The invention may also be applicable to other electronic surveillance and alarm security systems for commercial and residential buildings, as well as for other applications that use reed switch arrays. Any type of housings may be used for the magnet and switch housings, as is known in the art.

Figure 2A:
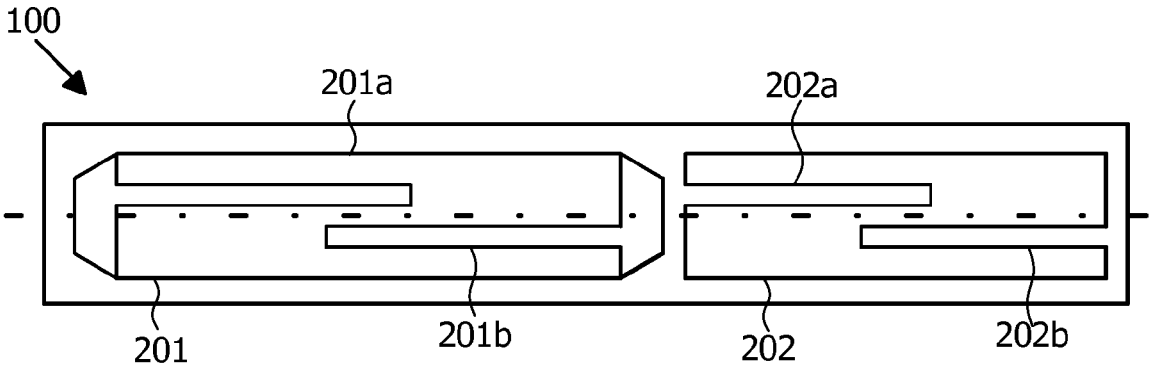
FIG. 2A shows a MEM's reed switch array constructed in accordance with another embodiment of the present invention.
Figure 5:
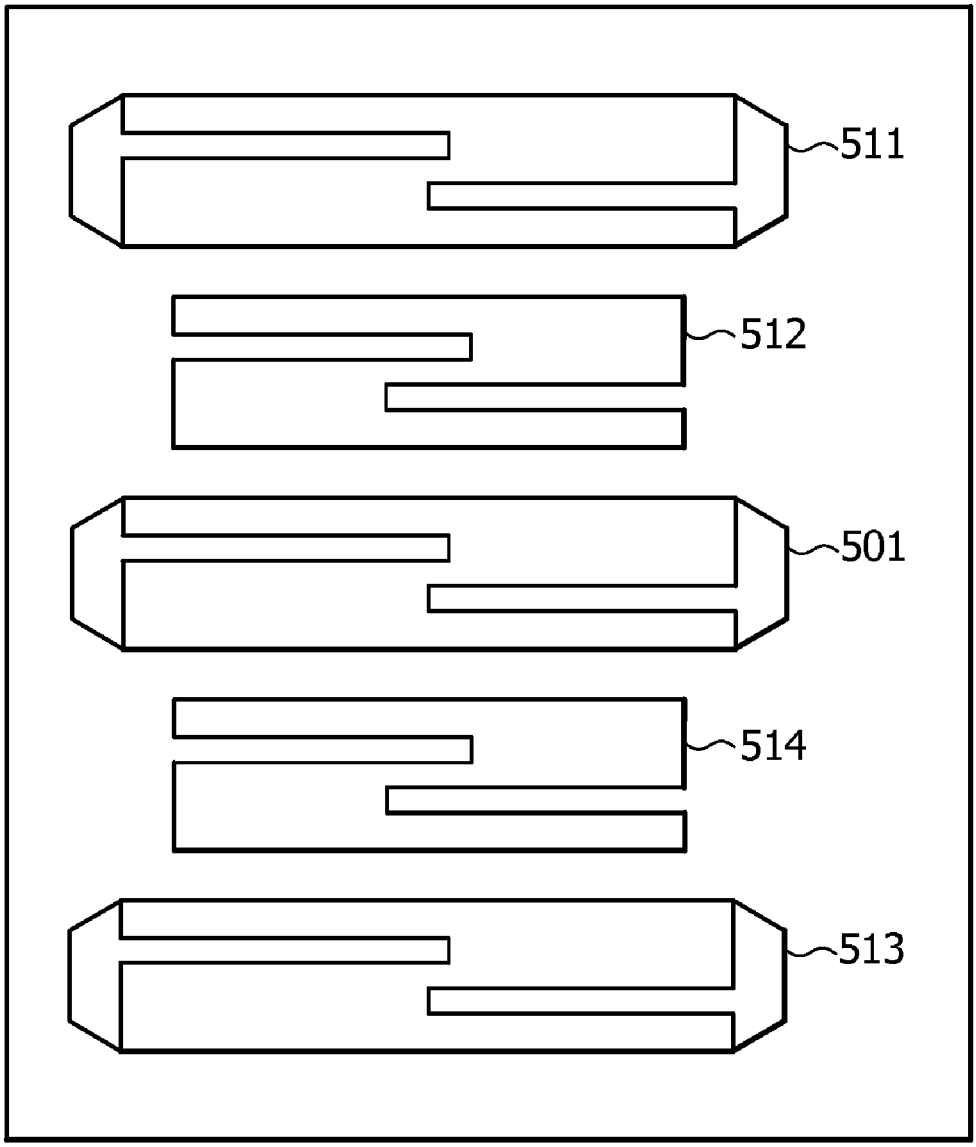
FIG. 5 shows a MEM's reed switch array constructed in accordance with another embodiment of the present invention.

Although only two switches are shown in FIGS. 2 and 2A, any number of switches may be used in the reed switch array. For example, five switches can be to achieve tamper protection in a small yet cost effective package. FIG. 5 shows center switch 501 of nominal sensitivity and two switches on each side, that is, a first switch 511 of greater sensitivity and a second switch 512 of lesser sensitivity on one side of the center switch 501, and a third switch 513 of greater sensitivity similar to the first switch 511 on one side of the center switch 501, and a fourth switch 514 of lesser sensitivity similar to the second switch 512 on the other side of the center switch 501. The two switches on either side can be positioned parallel with respect to the center switch 501,as shown. However, the horizontal center lines of the switches can be coaxial to each other. The switches can be provided at different positional and angular orientations, to provide higher levels of tamper protection.

While there has been shown and described what is considered to be preferred embodiments of the invention, it will, of course, be understood that various modifications and changes in form or detail could readily be made without departing from the spirit of the invention. It is therefore intended that the invention be not limited to the exact forms described and illustrated, but should be constructed to cover all modifications that may fall within the scope of the appended claims.

What is claimed is:

1. A MEM's reed switch array, comprising:

a first switch having a sensitivity causing said first switch to open or close due to a magnetic flux; and a second switch of lesser sensitivity than said first switch causing said second switch to open or close due to a magnetic flux, wherein when said first switch and said second switch are both open, due to an insufficient flux or no flux, an alarm is triggered.

2. The MEM's reed switch array of claim 1, wherein said first switch comprises:

a first leg; and a second leg;

wherein said magnetic flux causes said first leg of said first switch to come in contact with said second leg of said first switch, causing said first switch to close.

3. The MEM's reed switch array of claim 2, wherein said second switch comprises:

a first leg; and a second leg;

wherein said magnetic flux is insufficient to cause said first leg of said second switch to come in contact with said second leg of said second switch, causing said second switch to stay open.

4. The MEM's reed switch array of claim 3, wherein said first legs and said second legs of said first switch and said second switch are made of or are plated with magnetic material.

5. The MEM's reed switch array of claim 3, wherein said first legs and said second legs of said first switch and said second switch are made by etching silicon, and are plated with a ferrous material.

6. The MEM's reed switch array of claim 5, wherein said first legs and said second legs of said first switch and said second switch are plated with a non oxidizing material.

7. The MEM's reed switch array of claim 6, wherein said non oxidizing material is ruthenium, nickel or gold.

8. The MEM's reed switch array of claim 3, wherein said first and second legs of said first switch are made longer than said first and second legs of said second switch.

9. The MEM's reed switch array of claim 1, wherein said first switch is closed and said second switch is open, due to a proper magnetic flux being present, not triggering an alarm or a tamper warning.

10. The MEM's reed switch array of claim 1, wherein said first switch and said second switch are both closed, due to excess magnetic flux, generating a tamper warning.

11. The MEM's reed switch array of claim 1, wherein said first switch is parallel to said second switch.

12. The MEM's reed switch array of claim 1, wherein said first switch is proximate to said second switch so that a horizontal center line of said first switch is coaxial to a horizontal center line of said second switch.

13. The MEM's reed switch array of claim 1, wherein said first switch and said second switch are located inside a switch housing.

14. A MEM's reed switch array, comprising:

a first switch having a sensitivity causing said first switch to open or close due to a magnetic flux;

a second switch of lesser sensitivity than said first switch causing said second switch to open or close due to a magnetic flux;

a third switch having a sensitivity similar to said first switch;

a fourth switch having a sensitivity similar to said second switch; and a center switch in between the first and third switches and the second and fourth switches, said center switch having a nominal sensitivity.

15. The MEM's reed switch array of claim 14, wherein said first switch, second switch, third switch, fourth switch and center switch are parallel to each other.

16. The MEM's reed switch array of claim 14, wherein a horizontal center line of said first switch, second switch, third switch and fourth switch are all coaxial to a horizontal center line of said center switch.

17. The MEM's reed switch array of claim 14, wherein said first switch, second switch, third switch, fourth switch and center switch are located inside a switch housing.

18. A security device for residential and/or commercial use, said security device comprising:

a magnet housing having a magnet;

a switch housing having a MEM's reed switch array, said MEM's reed switch array comprising:

a first switch having a sensitivity causing said first switch to open or close due to a magnetic flux; and a second switch of lesser sensitivity than said first switch causing said second switch to open or close due to a magnetic flux; and a gap between said magnet housing and said switch housing, wherein when said first switch and said second switch are both open, due to an insufficient flux or no flux, an alarm is triggered.

19. The security device for residential and/or commercial use of claim 18, said security device further comprising:

a printed circuit board for holding said MEM's reed switch array.

20. The security device for residential and/or commercial use of claim 19, said security device further comprising:

circuitry means on said printed circuit board for processing switch positions of said first and second switches of said MEM's reed switch array.

21. The security device for residential and/or commercial use of claim 18, said security device further comprising:

wire leads or a terminal block attached to said switch housing to send data back to an alarm panel via wires or an RF transmitter to send wireless data.

22. The security device for residential and/or commercial use of claim 18, said security device further comprising:

attachment means for attaching said switch housing to a surface, and attachment means for attaching said magnet housing to a surface.

23. The security device for residential and/or commercial use of claim 18, wherein said first switch is parallel to said second switch.

24. The security device for residential and/or commercial use of claim 18, wherein said first switch is proximate to said second switch so that a horizontal center line of said first switch is coaxial to a horizontal center line of said second switch.

25. The security device for residential and/or commercial use of claim 18, wherein said first switch comprises:

a first leg; and a second leg;

wherein said magnetic flux causes said first leg of said first switch to come in contact with said second leg of said first switch, causing said first switch to close.

26. The security device for residential and/or commercial use of claim 25, wherein said second switch comprises:

a first leg; and a second leg;

wherein said magnetic flux is insufficient to cause said first leg of said second switch to come in contact with said second leg of said second switch, causing said second switch to stay open.

27. The security device for residential and/or commercial use of claim 26, wherein said first legs and said second legs of said first switch and said second switch are made of or are plated with magnetic material.

28. The security device for residential and/or commercial use of claim 26, wherein said first legs and said second legs of said first switch and said second switch are made by etching silicon, and are plated with a ferrous material.

29. The security device for residential and/or commercial use of claim 28, wherein said first legs and said second legs of said first switch and said second switch are plated with a non oxidizing material.

30. The security device for residential and/or commercial use of claim 29, wherein said non oxidizing material is ruthenium, nickel or gold.

31. The security device for residential and/or commercial use of claim 26, wherein said first and second legs of said first switch are made longer than said first and second legs of said second switch.

32. The security device for residential and/or commercial use of claim 18, wherein said first switch is closed and said second switch is open, due to a proper magnetic flux being present, not triggering an alarm or a tamper warning.

33. The security device for residential and/or commercial use of claim 18, wherein said first switch and said second switch are both closed, due to excess magnetic flux, triggering a tamper warning.

34. The security device for residential and/or commercial use of claim 18, wherein said MEM's reed switch array further comprises:

a third switch having a sensitivity similar to said first switch;

a fourth switch having a sensitivity similar to said second switch; and a center switch in between the first and third switches and the second and fourth switches, said center switch having a nominal sensitivity.

35. The security device for residential and/or commercial use of claim 18, wherein said security device has an operating range within a minimum operating gap and a maximum operating gap.

36. The security device for residential and/or commercial use of claim 35, wherein the minimum operating gap is determined by a maximum distance of the second switch between said switch housing and said magnetic housing.

37. The security device for residential and/or commercial use of claim 35, wherein the maximum operating gap is determined by a minimum distance of the first switch between said switch housing and said magnetic housing.

38. The security device for residential and/or commercial use of claim 18, wherein an alarm is triggered when said gap between said switch housing and said magnetic housing exceeds a maximum distance that said first switch can be closed at.

39. The security device for residential and/or commercial use of claim 18, wherein a tamper warning is generated when said gap between said switch housing and said magnetic housing is less than a minimum distance required to close said second switch.

* * * * *